US005997401A

United States Patent [19]

Crawford

[11] Patent Number: 5,997,401

[45] Date of Patent: Dec. 7, 1999

[54] SLOT MACHINE WITH SYMBOL SAVE FEATURE

[75] Inventor: Curtis J. Crawford, Henderson, Nev.

[73] Assignee: Sigma Game, Inc., Las Vegas, Nev.

[21] Appl. No.: 08/735,908

[22] Filed: Oct. 25, 1996

[51] Int. Cl.[6] ..... G07F 17/34

[52] U.S. Cl. ..... 463/20; 463/21; 463/19; 273/143 R

[58] Field of Search ..... 463/16, 17, 20, 463/21; 273/138.1, 143 R

[56] References Cited

U.S. PATENT DOCUMENTS

| | | | |
|---|---|---|---|
| 4,648,600 | 3/1987 | Olliges | 463/20 |
| 5,580,053 | 12/1996 | Crouch | 463/20 |
| 5,609,524 | 3/1997 | Inoue | 463/20 |
| 5,630,753 | 5/1997 | Fuchs | 463/20 |
| 5,704,835 | 1/1998 | Dietz, II | 463/20 |
| 5,807,172 | 9/1998 | Piechowiak | 463/20 |
| 5,839,956 | 11/1998 | Takemoto | 463/20 |

FOREIGN PATENT DOCUMENTS

| | | |
|---|---|---|
| 0 609 637 | 8/1994 | European Pat. Off. . |
| 2 050 028 | 12/1980 | United Kingdom . |
| 2 243 236 | 10/1991 | United Kingdom . |

*Primary Examiner*—Jessica J. Harrison
*Attorney, Agent, or Firm*—Skjerven, Morrill, MacPherson, Franklin & Friel LLp; Brian D. Ogonowsky

[57] ABSTRACT

A method for operating a rotating reel type slot machine, or a video machine which depicts rotating reels, is described herein which allows a player to save in memory one or more symbols from one or more previous games and use those symbols in a current game to obtain a winning combination. The display glass of the slot machine contains an area for displaying the symbols which have been saved.

13 Claims, 5 Drawing Sheets

SLOT MACHINE WITH SYMBOL SAVE FEATURE

FIELD OF THE INVENTION

This invention relates to slot machines and, in particular, to an additional playing feature for a slot machine.

BACKGROUND OF THE INVENTION

FIG. 1 illustrates the well known basic circuitry of a modern slot machine 10 which incorporates rotating reels. In such a slot machine 10, each of the reels 12, 13, and 14 has a variety of symbols printed on its periphery. Each of the reels 12–14 is driven by a separate stepper motor 16 which rotates in response to pulses from a CPU 18. When the pulses to a stepper motor 16 are terminated, the reel stops abruptly.

In modern slot machines, the stopping positions of the reels 12–14 are predetermined using a random number generator consisting of a random number generator program in the program ROM 20 carried out by the CPU 18. The required number of pulses to the three stepper motors are then generated to display the symbol combination at the predetermined reel positions.

In one common type of slot machine, the number of pulses after the reel has reached a zero position are counted to determine the final position of the reels. In another type of machine, each of the reels has tabs that are sensed by a photodetector to determine the angular displacement of the reel and thus the final displayed symbol. Other means for detecting the positions of the reels exist and are well known.

A money detector 22, which may detect coins or other currency, issues a command to the CPU 18 that the slot machine 10 is ready to be played. The player may then pull a handle 24 or press a button to initiate play.

After the reels have stopped, and the CPU 18 determines the final stop positions, the stop positions are then applied to a pay-table ROM 26, which cross-references the final displayed symbols with a monetary payout to the player. This payout is then conveyed to a payout mechanism 28 which issues coins or credits to the player. A display 30 may also be activated, signalling a win to the player.

The above general description of a modern slot machine would be well known in the art, and such a programmable machine offers great advantages. Slot machines are varied by simply changing the operating program in the program ROM 20 and the award program in the pay-table ROM 26. The front glass of the slot machine is also changeable to convey particular features of the machine.

Additional detail of such conventional slot machines is found in U.S. Pat. No. 4,095,795 to Saxton et. al.; U.S. Pat. No. 4,448,419 to Telnaes; and U.S. Pat. No. 4,573,681 to Okada, all incorporated herein by reference.

One well known award criterion for a 3-reel slot machine is the matching of symbols in a horizontal direction. After each game, the player again pulls the handle so that each game is completely independent of all previous games.

Although the slot machine of FIG. 1 is very successful, even more player appeal would be created by allowing the player additional possibilities for winning.

SUMMARY

A method for operating a rotating reel type slot machine, or a video machine which depicts rotating reels, is described herein which allows a player to save in memory one or more symbols from one or more previous games and use those symbols in a current game to obtain a winning combination. The invention may be implemented by relatively minor changes in the software code in the program ROM and the pay-table ROM of a conventional slot machine.

The display glass of the slot machine contains an area for displaying the symbols which have been saved for that reel position.

DETAILED DESCRIPTION OF THE PREFERRED EMBODIMENT

Figure 2:
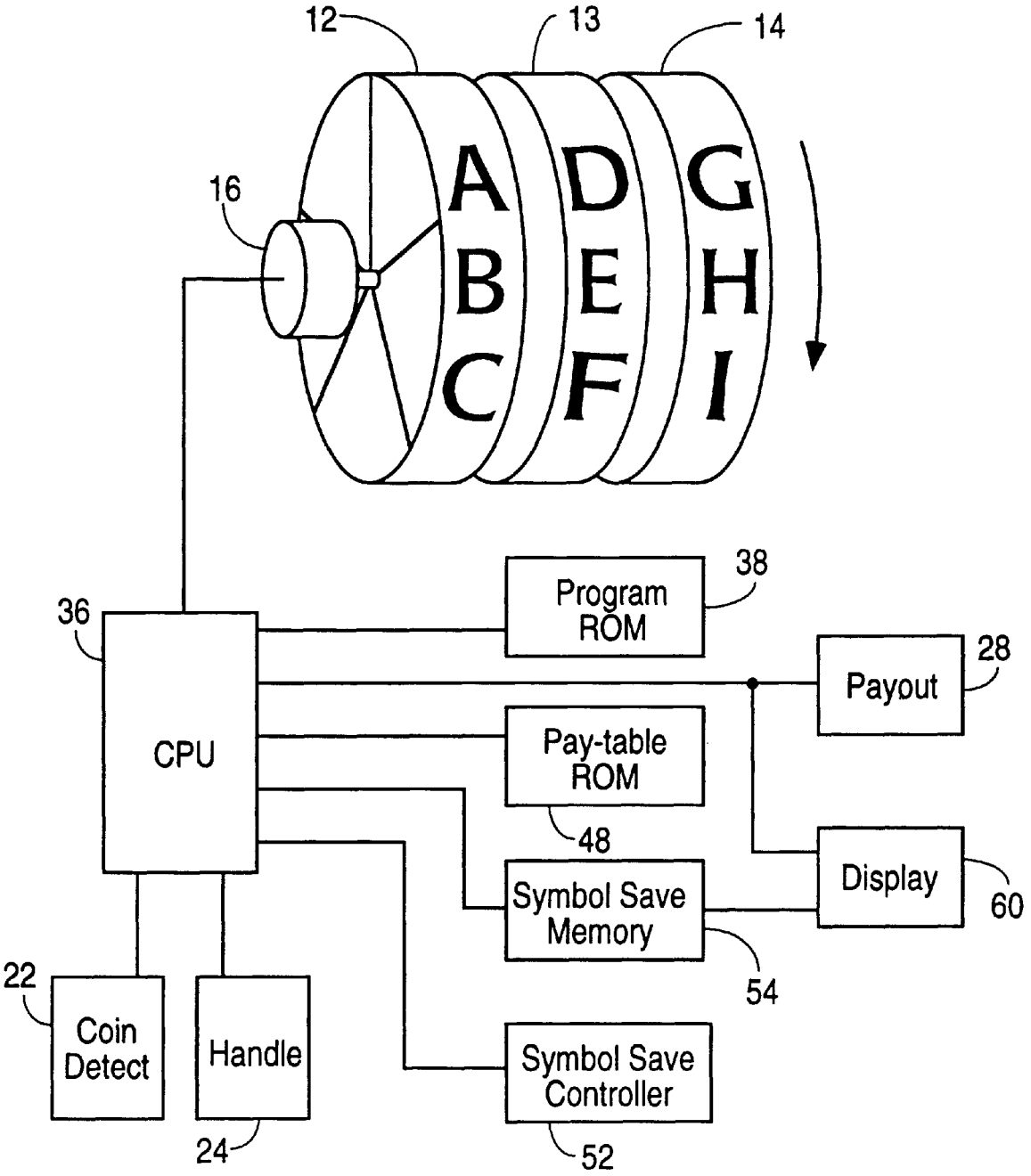
FIG. 2 illustrates the circuitry of FIG. 1, but augmented to incorporate the present invention.

FIG. 2 illustrates the circuitry used in a slot machine in accordance with the present invention. Elements identified with the same numerals in the various figures may be identical and will not be redundantly described.

Figure 1:
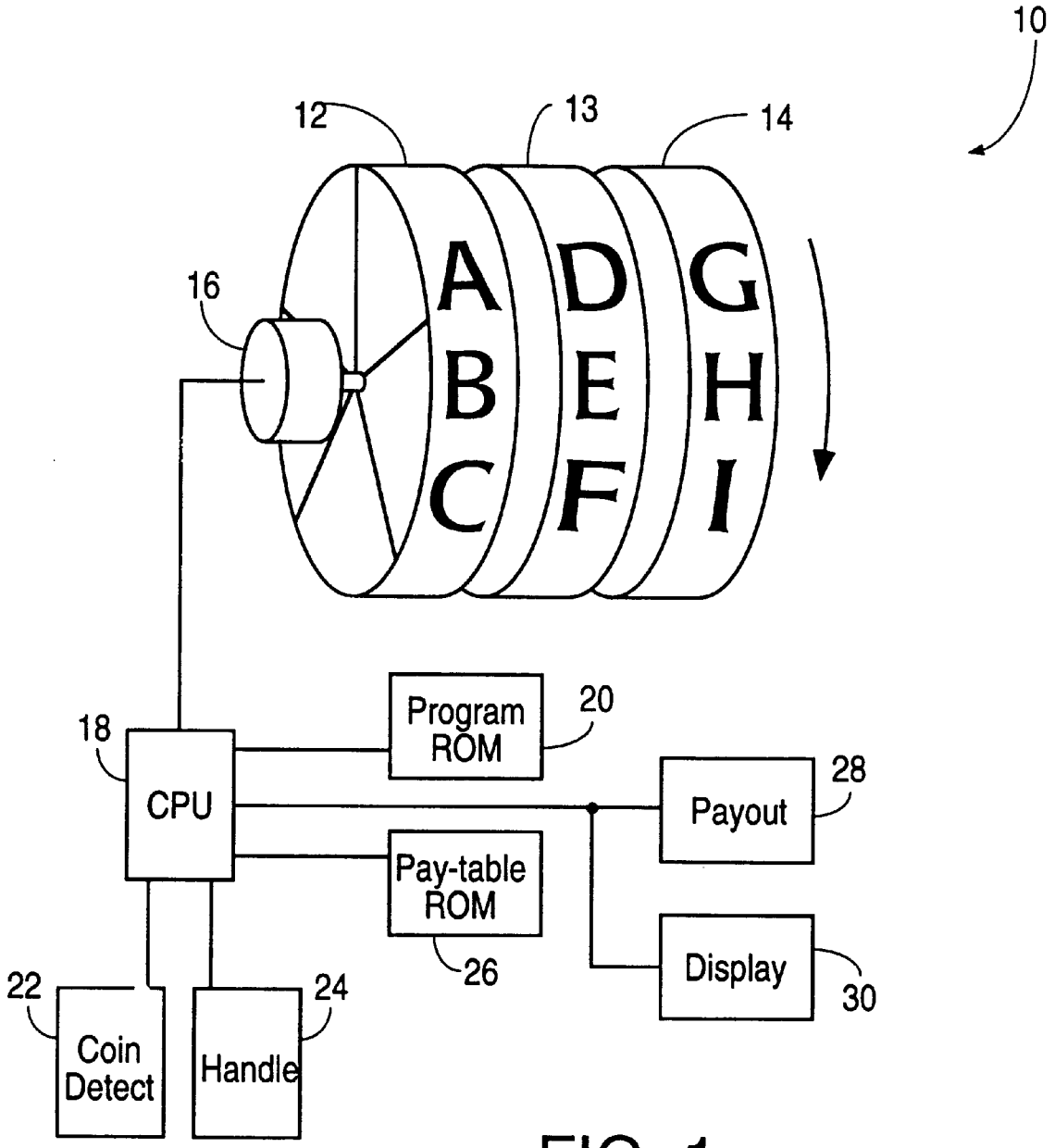
FIG. 1 (Prior Art)
FIG. 1 illustrates well-known circuitry for operating a slot machine.

The slot machine of FIG. 2 performs the same functions as the conventional slot machine of FIG. 1 has an additional feature. This feature will be referred to as a symbol save feature, which allows a player to save any displayed symbol for use in a subsequent game. Symbols may be saved manually by pressing a button, or, alternatively, the machine may automatically save special symbols for the player's use in later games. A description of the invention will be presented with reference to FIG. 2, the front view of a slot machine in FIG. 3, and the flow chart of the slot machine operation in FIG. 4.

In step 1, a coin is deposited through slot 32 (FIG. 3) and is detected by a coin detector 22 (FIG. 2). A paper currency slot and reader may also be incorporated in the slot machine of FIG. 3. The detection of the coin and the pulling of handle 24, or the pressing of button 34, initiates a next game, as indicated in step 2 of FIG. 4.

Figure 4:
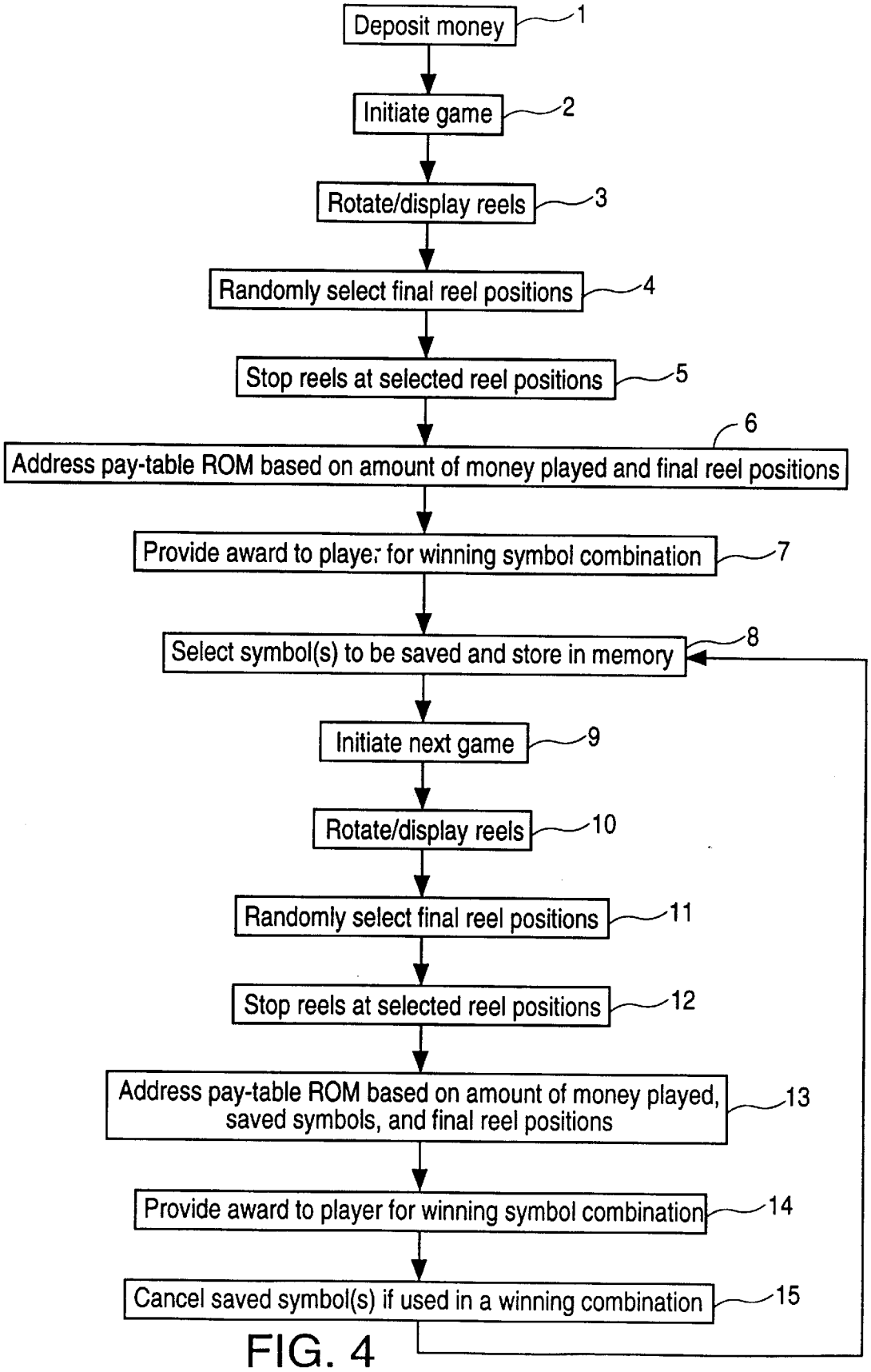
FIG. 4 is a flow diagram illustrating the basic steps carried out by the slot machine in accordance with the present invention.

A CPU 36 (FIG. 2), under control of a program ROM 38, rotates the reels 12–14 by issuing pulses to stepper motors 16, as indicated by step 3 in FIG. 4. In step 4, a random number generator in the program ROM 38 selects the final reel positions for reels 12–14. CPU 36 issues the required number of pulses to stepper motors 16 in order to cause the reels 12–14 to reach their final positions. The positions of the reels 12–14 may be determined by either counting the number of pulses to each stepper motor 16 or by counting pulses generated by a photo-optical element which detects tabs around the periphery of each of reels 12–14. Such methods of selecting a final reel position and stopping the reels at the selected reel positions are well known and commonly used in the art. In step 5, the reels are stopped at their selected positions.

Figure 3:
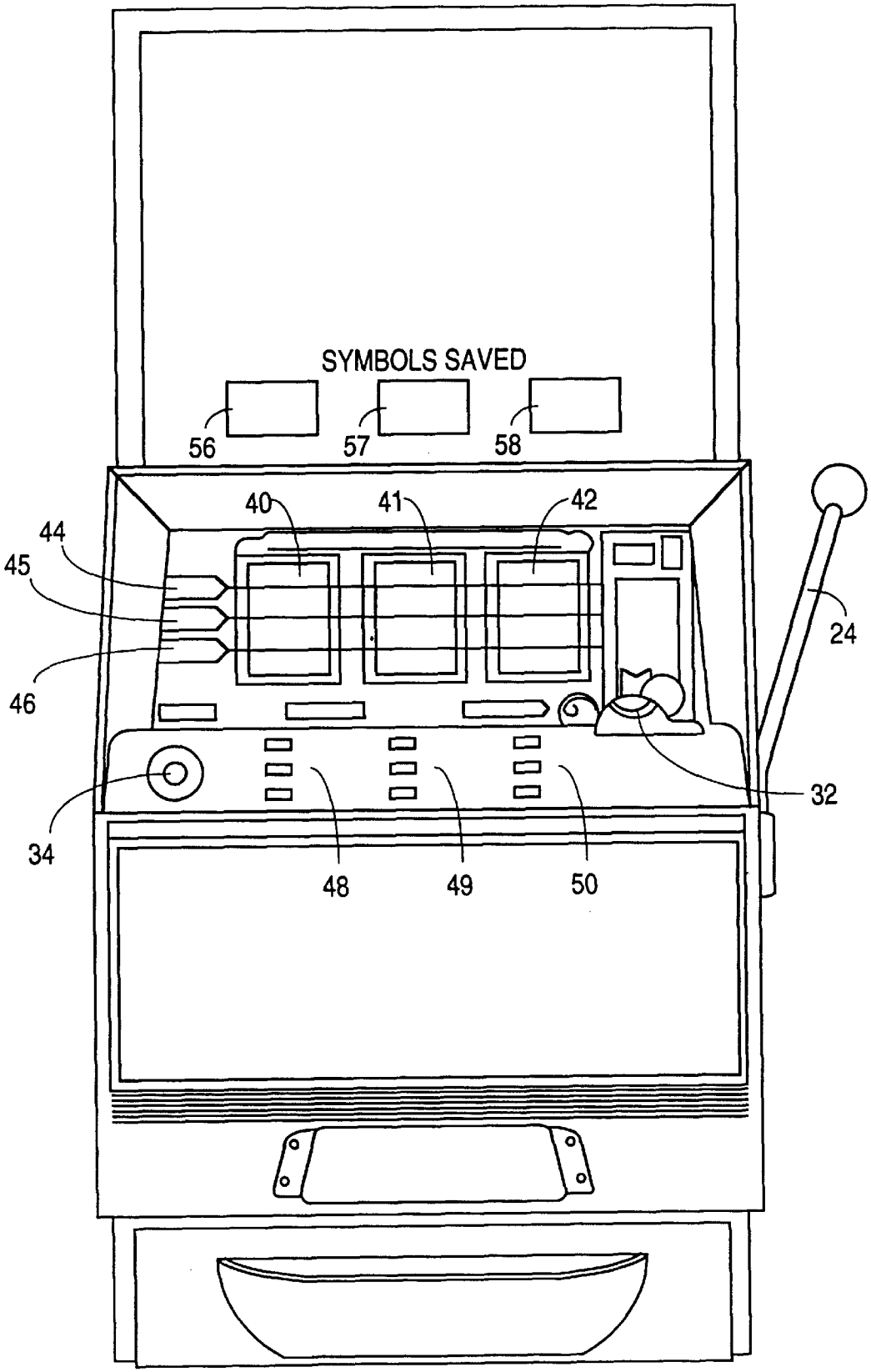
FIG. 3 is a front view of a slot machine incorporating the present invention.

The reels are displayed through display windows 40, 41, and 42 in FIG. 3. A slot machine incorporating this invention may include more than 3 reels. In the particular embodiment shown in FIG. 3, three consecutive symbols on each of reels 12–14 are displayed through the display windows 40–42. A symbol may be any image and may even be a blank. Three paylines 44, 45 and 46 are printed on the display glass of the slot machine to identify the paylines which are applicable for a particular play. Typically, the deposit of one coin will activate the center payline 45, and additional coins will activate the paylines 44 and 46. A winning combination of symbols appearing across any activated payline will result in a win for that player.

In step 6 of FIG. 4, a pay-table ROM 48 (FIG. 2) is addressed with an address based upon the number of coins played and the final reel positions. For example, if three coins were played, a winning combination across any of the three paylines 44–46 would be acknowledged by the pay-table ROM 48 as a win. The pay-table ROM 48 provides a signal to CPU 36 to control a payout mechanism 28 to provide the number of coins or credits to the player corresponding to the winning symbol combination, as shown in step 7 of FIG. 4.

The operation of the preferred slot machine, thus far, has been that of a conventional slot machine. The present invention can also be used in slot machines which have only a single payline or which use a CRT or other flat screen display to represent the rotation of reels rather than provide actual mechanical reels.

After the reels have stopped, the player may elect to save one or more symbols displayed for each reel position. This may be accomplished by pressing one or more buttons 48, 49, and 50 (FIG. 3) associated with each reel. In one embodiment of a slot machine having three paylines, there are three buttons per reel to select a symbol on any one of the paylines. Hence, up to three symbols per reel may be saved. In another embodiment, only one symbol per reel can be saved.

In another embodiment, only special symbols may be designated by the machine as the symbols applicable to the symbol save feature. In such an embodiment, the machine itself may automatically save these special symbols as they appear in the display windows 40–42.

The manual saving of symbols by buttons 48–50 or the automatic saving of symbols is indicated by the symbol save controller 52 in FIG. 2 and indicated by step 8 in FIG. 4.

The saved symbols are stored in a symbol save memory 54 (FIG. 2), and the save symbols are displayed to the user in display areas 56, 57 and 58 in FIG. 3. In one embodiment, an image of the saved symbol(s) is illuminated in areas 56–58 in FIG. 3. Any arrangement of a display for displaying the saved symbols to the player may be used, and such a display is designated as display 60 in FIG. 2.

In the preferred embodiment, any symbol from a reel which is saved by the player or the machine only applies to that same reel position in subsequent games. Thus, the saved symbol originally displayed in display window 40 will appear in display area 56 and can only be later used in combination with symbols displayed in windows 41 and 42 or with symbols saved in display areas 52 and 58. In another embodiment, the origin of the saved symbol is not relevant, and the saved symbol(s) can be used with any reel combination.

The player may then deposit more coins and initiate a next game, as shown in step 9 of FIG. 4. The step of saving symbols, instead of being conducted before additional coins or credits are wagered, may be conducted after additional coins or credits are wagered but before the initiation of the next game. Again, the reels are rotated, the final reel positions are randomly selected, and the reels are stopped, as shown in steps 10, 11, and 12, respectively, in FIG. 4.

A winning combination of symbols may now be determined by using the currently displayed symbols by the reels 12–14 and the saved symbols from one or more previous games. The pay-table ROM 48 is then provided an address which may be based upon, for example, the number of coins played, the saved symbols, and the symbols displayed by the reels to determine whether there is a winning combination of symbols and to determine the award to be played to the player, as shown in step 13 of FIG. 4. Other criteria for addressing the pay-table ROM 48 or other circuitry for providing an award to the player may also be used.

The output of the pay-table ROM 48 is provided to CPU 36, which then controls the pay-out mechanism 28 to provide the corresponding award to the player for the winning symbol combination, as shown in step 14 of FIG. 4, and the display of the saved symbols is extinguished.

If a winning combination used any of the saved symbols, the saved symbols are canceled, as shown in step 15 of FIG. 4, and the display of the saved symbols is ceased.

The player may now select additional symbols to save and store in the symbol save memory 54, as illustrated by the return path in FIG. 4.

Figure 5:
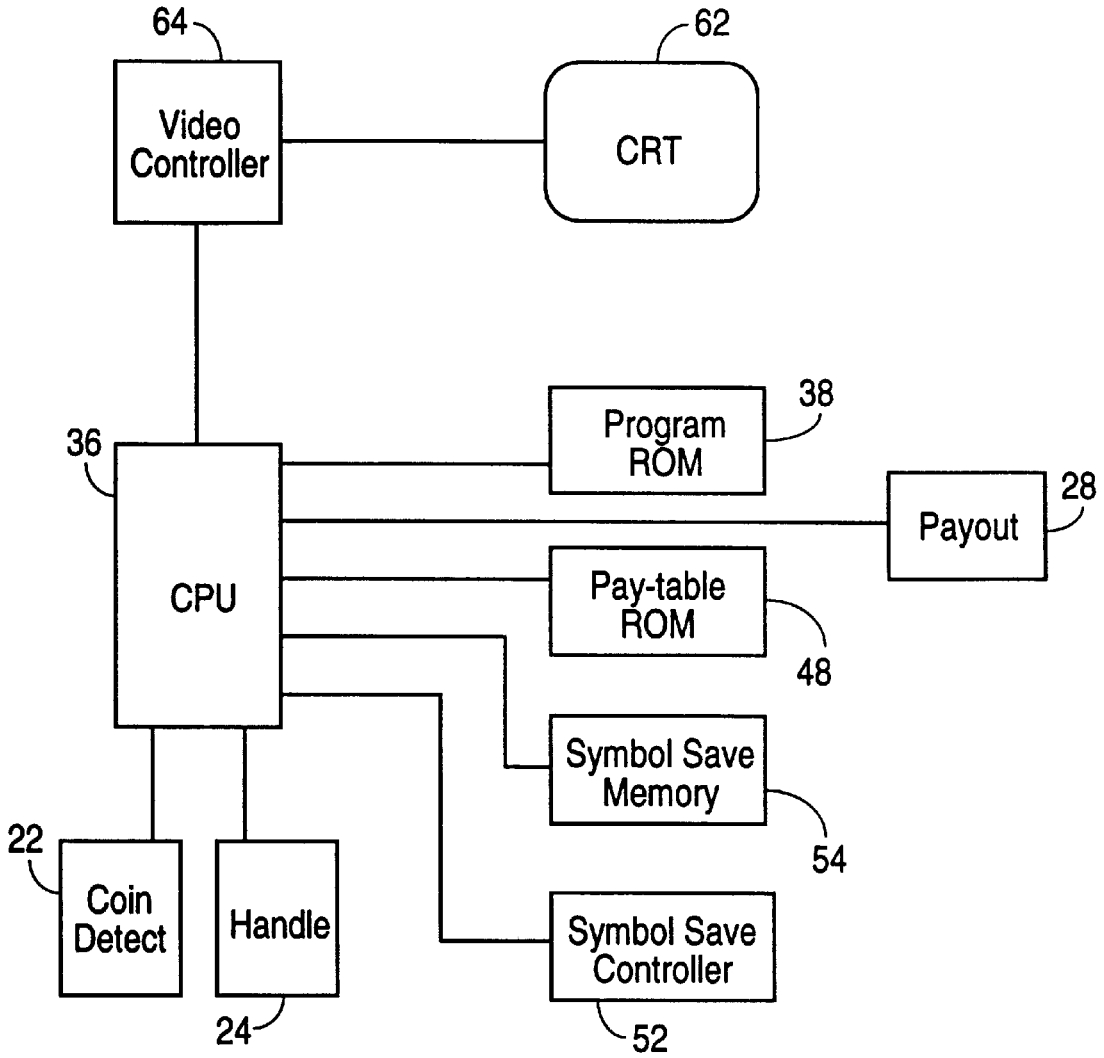
FIG. 5 illustrates circuitry similar to FIG. 2, but modified for controlling a video slot machine displaying rotating reels.

FIG. 5 illustrates the circuitry used in a video slot machine which displays an animated version of rotating reels on a CRT 62. A video controller 64 controls CRT 62 and receives commands from CPU 36. One skilled in the art would understand the requirements for video controller 64 and CPU 36, since these devices would be generic to a wide variety of video slot machines. In a video slot machine, a separate display to identify the saved symbols is not required since the saved symbols would be displayed on CRT 62.

One skilled in the art could easily modify conventional slot machine programs stored in a program ROM to incorporate the symbol save feature of this invention. One skilled in the art could also easily modify the conventional program in a pay-table ROM to take into account the symbols saved in memory 54 when determining whether a winning combination exists. The symbol save controller 52 may easily be implemented by determining the displayed symbol corresponding to buttons 48–50, since the final positions of the reels are already known by CPU 36. Accordingly, one skilled in the art may implement numerous embodiments of this invention without further technical description.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A slot machine comprising:

a display portion displaying a plurality of rotatable reels, each reel having a plurality of symbols on its periphery;

a means for rotating said reels and stopping said reels such that at least two symbols on each reel are displayed to a player of the slot machine across at least two horizontal paylines;

a selector for allowing said player to store at least two of said displayed symbols per reel as one or more saved symbols in a memory for use in a subsequent game, said selector being available for use by said player to store said symbols after each game, stored symbols being available for use by said player for multiple subsequent games;

a display area associated with each of said rotatable reels for displaying said one or more saved symbols of said respective reel; and an award means for awarding a payment to said player for winning combinations of symbols using both said one or more saved symbols and currently displayed symbols for determining a winning combination of symbols.

2. The slot machine of claim 1 wherein said display portion comprises said rotatable reels rotated by a motor.

3. The slot machine of claim 1 wherein said display portion comprises an electronic display for displaying said rotatable reels on a display screen.

4. The slot machine of claim 1 wherein said selector comprises a plurality of buttons associated with each of said rotatable reels, wherein depression of one of said plurality of buttons stores a displayed symbol on an associated reel as a saved symbol in said memory for use in a subsequent game.

5. The slot machine of claim 1 wherein said selector comprises a different selector for each of said rotatable reels.

6. The slot machine of claim 1 wherein said rotatable reels comprise a first reel, a second reel, and a third reel, said selector comprising a different selector for each of said rotatable reels, wherein activating a selector for one of said rotatable reels causes a displayed symbol on said one of said rotatable reels to be saved for use in combination only with symbols displayed by the remaining rotatable reels.

7. The slot machine of claim 1 wherein said rotatable reels comprise a first reel, a second reel, and a third reel, said selector comprising a different selector for each of said rotatable reels, wherein activating a selector for one of said rotatable reels causes a displayed symbol on said one of said rotatable reels to be saved for use in combination with displayed symbols on any of said rotatable reels.

8. The slot machine of claim 1 further comprising a means for canceling one or more of said saved symbols in said memory after a payment to said player has been made for a winning combination utilizing one or more of said saved symbols.

9. A method for operating a slot machine comprising the steps of:

rotating reels in said slot machine, each reel having a plurality of symbols around its periphery;

stopping said reels to display at least two symbols on each reel in a particular symbol combination;

selecting two or more displayed symbols for at least one of said reels to be saved and stored in a memory, said machine allowing a player to perform said step of selecting after each game, stored symbols being available for use by said player for multiple subsequent games;

displaying said saved symbols in a display area associated with the respective reel;

rotating each of said reels subsequent to said step of selecting;

stopping said reels to display at least two symbols on each reel in another particular symbol combination; and determining a payment to a player for a winning combination of symbols using both saved symbols and currently displayed symbols for determining a winning combination of symbols.

10. The method of claim 9 wherein said step of selecting comprises pressing a button associated with each of said reels to save a symbol displayed by an associated reel.

11. The method of claim 9 wherein symbols saved during said step of selecting are used in combination with any other symbols displayed by said reels for determining a winning combination of symbols.

12. The method of claim 9 wherein symbols saved during said step of selecting are used in combination only with symbols on reels other than the reel associated with the saved symbol, for determining a winning combination of symbols.

13. The method of claim 9 further comprising the step of canceling one or more saved symbols once it has been determined that a winning combination of symbols uses said one or more saved symbols in combination with one or more currently displayed symbols on said reels.

* * * * *